United States Patent [19]

Bauer

[11] 4,407,253

[45] Oct. 4, 1983

[54] FUEL INJECTION PUMP FOR SELF-IGNITING INTERNAL COMBUSTION ENGINES

[75] Inventor: Manfred Bauer, Ludwigsburg, Fed. Rep. of Germany

[73] Assignee: Robert Bosch GmbH, Stuttgart, Fed. Rep. of Germany

[21] Appl. No.: 247,445

[22] Filed: Mar. 25, 1981

[30] Foreign Application Priority Data

Apr. 3, 1980 [DE] Fed. Rep. of Germany ..... 3013087

[51] Int. Cl.[3] ..... F02M 37/04

[52] U.S. Cl. ..... 123/506; 123/449; 123/459

[58] Field of Search ..... 123/506, 503, 449, 459; 417/289, 304

[56] References Cited

U.S. PATENT DOCUMENTS

| | | | |
|---|---|---|---|
| 3,614,270 | 10/1971 | Franke et al. | 417/304 |
| 3,667,438 | 6/1972 | Moulin et al. | 123/506 |
| 3,699,939 | 10/1972 | Eckert et al. | 123/506 |
| 3,777,731 | 12/1973 | Kobayashi et al. | 123/449 |
| 3,942,914 | 3/1976 | Hofer et al. | 123/449 |
| 4,164,921 | 8/1979 | Hofer et al. | 123/506 |
| 4,211,203 | 7/1980 | Kobayashi | 123/503 |
| 4,271,808 | 6/1981 | Kobayashi et al. | 123/506 |

FOREIGN PATENT DOCUMENTS

| | | | |
|---|---|---|---|
| 391964 | 5/1933 | United Kingdom | 123/503 |
| 686637 | 9/1979 | U.S.S.R. | 123/449 |

*Primary Examiner*—Charles J. Myhre
*Assistant Examiner*—Magdalen Moy
*Attorney, Agent, or Firm*—Edwin E. Greigg

[57] ABSTRACT

A fuel injection pump is proposed in which, at relatively low rpm, there is an outflow of a partial quantity of fuel for the purpose of prolonging the injection time. This outflow begins only after the injection has already begun.

16 Claims, 4 Drawing Figures

FUEL INJECTION PUMP FOR SELF-IGNITING INTERNAL COMBUSTION ENGINES

BACKGROUND OF THE INVENTION

The invention is based on a fuel injection pump for supplying fuel to injection nozzles of self-igniting internal combustion engines. The pump comprises a housing means within which a bore and a suction chamber are defined. A pump piston is mounted for reciprocating movement within the bore as a function of engine rpm, the housing means and piston defining a pump work chamber in said bore. An intake connected to the suction chamber communicates with the work chamber through which fuel is delivered from the suction chamber to the work chamber. The reciprocating movement of the piston includes a compression stroke during which fuel is compressed to an injection pressure for discharge through a plurality of pressure lines, each of which is connected at one end to the housing means in communication with the work chamber and at its other end to an injection nozzle.

With fuel injection pumps for Diesel engines, a goal is to prolong the duration of injection during idling and at low partial load, so as to attain quieter idling. In a known fuel injection pump of this kind, fuel is directed simultaneously via the relief conduit and via the pressure lines during idling and low partial load, after the compression stroke of the pump piston has begun. However, before the fuel injection nozzles open, a higher pressure is temporarily established than that which will be required after opening for the further injection of relatively small injection quantities. This advance pressurization causes rpm-dependent variations in the actual onset of injection and also results in substantial, undesirable differences in the partial quantity flowing out. Furthermore, the partial quantity in this known pump flows into a withdrawal chamber, which functions similarly to a reservoir and thus exerts substantial influence on the course of injection, having the particular disadvantage that precise regulation of the injection quantity is made more difficult.

OBJECT AND SUMMARY OF THE INVENTION

The principal object of the fuel injection pump according to the invention, is to provide a pump which has the advantage over the prior art that the onset of injection is effected very precisely.

Another object of the invention is to provide continuity in the regulation of the injection quantity. In actual practice, factors affecting quiet-idling criteria are detected and examined.

A further object of the invention provides that initially-adjusted tolerances and pump-specific parameters for adjusting the individual nozzle opening pressures independently of the inventive provision for prolonging the injection time.

The invention will be better understood and further objects and advantages thereof will become more apparent from the ensuing detailed description of several preferred embodiments taken in conjunction with the drawings.

DESCRIPTION OF THE PREFERRED EMBODIMENTS

Figure 1:
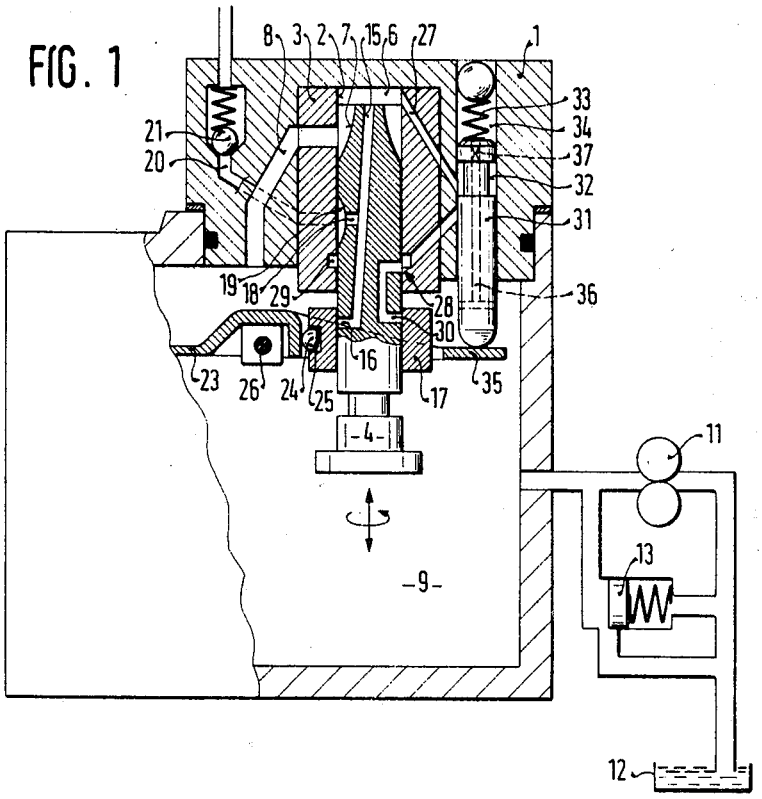
FIG. 1 is a partial sectional view of a first exemplary embodiment of the invention.

The three exemplary embodiments illustrated in the four drawings are of a distributor-type injection pump shown in highly simplified form. As may be seen from FIG. 1, a pump piston 4 operates in a bore 2 of a cylindrical sleeve 3 inserted into the housing 1 of a fuel injection pump. The pump piston 4 is caused to rotate and reciprocate simultaneously by known means (not shown) counter to the force of a restoring spring, also not shown. The pump work chamber 6 of this pump is supplied with fuel from a suction chamber 9 via longitudinal grooves 7 provided in the jacket face of the pump piston 4 and via an intake bore 8 extending through the cylindrical sleeve 3 and within the housing 1. The supply is effected when the pump piston 4 is executing its intake (downward) stroke or upon assuming a bottom dead center position as a result of the underpressure prevailing in the suction chamber 9. The suction chamber 9 is supplied with fuel out of a fuel container 12 via a supply pump 11. The pressure in the suction chamber 9 is controlled in accordance with rpm in a known manner by means of a pressure control valve 13, so that the pressure in the suction chamber 9 increases as the rpm level increases.

A longitudinal conduit 15 extends within the pump piston 4, communicating on one end with the pump work chamber 6 and on the other end with the suction chamber 9. The exit opening 16 of this conduit 15 is controlled by means of an annular slide 17 guided on the pump piston 4. A transverse bore 18 branches off from the longitudinal conduit 15 and discharges into a longitudinal distributor groove 19 provided in the jacket face of the piston 4. During the compression (upward) stroke of the pump piston, as it rotates, the intake bore 8 is closed and one of the pressure lines 20 is opened via the longitudinal conduit 15, the transverse bore 18 and the distributor groove 19. Thus the fuel can flow out of the pump work chamber 6 into the particular pressure line 20 which has been opened at that time. The pressure lines 20 variously lead via a check valve 21 to pressure lines leading in turn to injection nozzles disposed on the engine. After a predetermined supply stroke has been executed, the exit opening 16 of the longitudinal conduit 15 is opened by the emergence thereof from the annular slide 17; as a result, the fuel injection is interrupted and the remaining fuel flows out of the pump work chamber 6 into the suction chamber 9.

The annular slide 17 is displaced with respect to the pump piston 4 via an intermediate lever 23 connected to an rpm governor, not shown, in accordance with load and rpm. To effect this relative displacement, the intermediate lever 23 is provided with a head 24 which engages a recess 25 of the annular slide 17. The intermediate lever is pivotably supported on a shaft 26 so that it can be actuated. A downward displacement of the head 24 effects a reduction of the injection quantity by revealing a portion of the exit opening 16, and an upward displacement effects an increase in the injection quantity by sealing the exit opening against fuel escape. For starting rpm, the annular slide 17 assumes its highest position, at which point the exit opening 16 is no longer open; thus, the entire fuel quantity is delivered through the longitudinal conduit 15 and proceeds to injection.

Also branching off from the pump work chamber 6 is a throttle relief conduit 27 comprising two channels through both the sleeve 3 and through the housing 1. The throttle relief conduit is controlled at an orifice 28 adjoining the pump piston 4. The disposition of this orifice 28 is selected such that the relief conduit 27 is opened only after a predetermined stroke of the pump piston 4 has been executed, although at that moment in time one of the pressure lines 20 will already have been opened via the distributor groove 19. As a result, an injection onset pressure is attained in the pump work chamber 6 which is both sufficiently high and identical to that attained during all the compression strokes.

In the first exemplary embodiment shown in FIG. 1, the relief conduit 27 branches off directly from the pump work chamber 6, and the conduit entrance there is not controlled by the pump piston. At the orifice 28, however, the relief conduit 27 discharges into an annular groove disposed in the sleeve 3, and the annular groove 29 cooperates with a conduit 30 extending within the pump piston 4. The end of the conduit 30 is again controlled by the annular slide 17 and likewise remains closed at starting rpm, so that at starting rpm no fuel can flow out of the pump work chamber 6 by way of the relief conduit 27. The entrance to the conduit 30 is opened by the annular groove 29 only after a predetermined stroke of the pump piston 4 has been executed—in other words, only after the onset of injection (as shown in FIG. 1). It is also conceivable, however, that the conduit 30 could again be blocked after passing the annular groove 29, so that the opening of the annular groove 29 would occur solely for a specified section of the stroke. The end of the conduit 30, controlled by the annular slide 17, emerges from the inner bore of the annular slide toward the end of the injection stroke. At partial load and during idling, this opening of the conduit 30 occurs correspondingly earlier, so that the outflow can occur only in this rpm range. It is this outflow which effects quiet idling.

The relief conduit 27 is further controlled by a control slide 31 as follows: the first channel of the relief conduit 27, which is under high pressure derived from the pump work chamber 6, discharges into an annular groove 32, while the second channel of the relief conduit, extending between the annular groove 32 and the orifice 28, is arranged to be blocked by a jacket face of the control slide 31 whenever it assumes the position shown in the FIG. 1. This position corresponds to rpm levels above idling and lower partial-load rpm levels. At idle and at lower partial-load rpm, the relief conduit 27 is opend by the control slide 31 because a spring 33 correspondingly pushes the control slide 31 downward.

The actuation of the control slide 31 may be effected by means of the rpm-dependent pressure in the suction chamber 9, in which case the chamber 34 receiving the spring 33 must be relieved of pressure. As the drawing reveals, however, the control slide 31 is actuated in a variant manner, by means of an extension 35 on the intermediate lever 23, and in that case it is the suction chamber pressure which prevails in the chamber 34. For the purpose of pressure equalization, a corresponding line 36 extends within the control slide 31 and is provided with a throttle 37 at the extremity thereof adjacent to the chamber 34. As a result, the movement of the annular slide 17 is damped, especially in the shut-off range.

Figure 2:
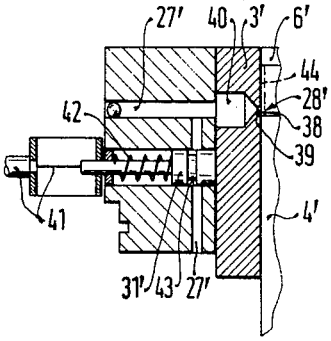
FIG. 2 is a partial sectional view of a second exemplary embodiment of the invention.
Figure 3:
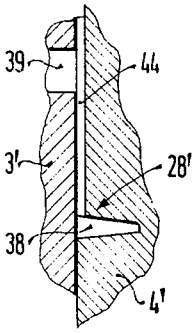
FIG. 3 is a greatly enlarged partial section of a portion of the second exemplary embodiment of the invention.

In the second exemplary embodiment shown in FIGS. 2 and 3, only a portion of the distributor-type fuel injection pump is shown, and for the sake of simplicity those elements corresponding to those of the embodiment of FIG. 1 are given identical reference numerals with a prime. While FIG. 2 is approximately identical in scale with FIG. 1, FIG. 3 shows a detail from FIG. 2 on a larger scale. Differing from the first exemplary embodiment, the apparatus in the second exemplary embodiment which effects the prolongation of the injection time is shown disposed alongside the pump piston 4'. The orifice 28' between the pump piston 4' and the relief conduit 27' is provided by an annular groove 38 in the pump piston and by a throttle bore 39, which represents the entrance to the relief conduit 27'. Adjoining the throttle bore 39 is an enlarged bore 40 within the cylindrical sleeve 3, which then forms a portion of the relief conduit 27'. The relief conduit 27' is controlled by a control slide 31' disposed transversely to the axis of the pump piston 4'. The control slide 31' is arbitrarily adjustable by means of a Bowden cable 41 counter to the force of a spring 42. Alternatively, it is also possible to pivot the control slide 31' via the rpm lever. The control of the relief conduit 27' provided by means of an annular groove 43 of the control slide 31' may also serve as a passage throttle of the relief conduit 27'. In FIG. 3, the orifice 28' of this exemplary embodiment in shown on a larger scale. The annular groove 38 communicates via longitudinal grooves 44 with the pump work chamber 6'. The cross section of the throttle bore 39 in the cylindrical sleeve 3' may preferably be rectangular in shape. During the compression stroke, the annular groove 38 passes this throttle bore 39, so that only during the time of overlap is a partial quantity of fuel able to flow out of the pump work chamber 6' into the relief conduit 27'. This embodiment has the advantage, shared also by the first exemplary embodiment, that the withdrawal of a partial fuel quantity has no influence on the onset of injection or on the end of injection; nor does such withdrawal actually have any effect on the regulation of rpm.

Figure 4:
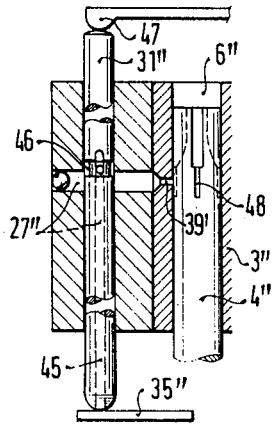
FIG. 4 is a partial sectional view of a third exemplary embodiment of the invention.

The third exemplary embodiment shown in FIG. 4 substantially corresponds to the embodiments already described. The control slide 31'' controls the relief conduit 27'', and a portion of the relief conduit 27'' extends within a blind bore 45 of the control slide 31''. This blind bore 45 terminates in an annular groove 46 of the control slide, and the annular groove 46 in turn communicates with a transverse bore. After the appropriate displacement of the control slide 31'', this annular groove 46 is separated from the conduit 27'', so that a blockage of the relief conduit 27'' results. The control slide 31'' is actuated either arbitrarily via an adjusting lever 47 and/or by means of a governor lever 35''. The control of the throttle bore 39' of the relief conduit 27'', which as in the second exemplary embodiment is disposed in the cylindrical sleeve 3'', is effected by means of longitudinal grooves 48 within the distributor 4'', which communicate with the pump work chamber 6'' and with the bore 39 to open the bore only temporarily upon the rotation of the pump piston.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection pump for supplying fuel to injection nozzles of self-igniting internal combustion engines, having: housing means within which a bore and a suction chamber are defined; a pump piston mounted for reciprocating movement within the bore as a function of engine rpm, said housing means and piston defining a pump work chamber in said bore, a plurality of pressure lines, each adapted to be connected at one end to the housing means for communicating with the work chamber and at the other end to an injection nozzle, and a fuel injection quantity control device for changing the fuel quantity delivered by said fuel injection pump into said pressure lines as a function of engine parameters, the improvement comprising:

a relief conduit containing a throttle, the relief conduit being connected to the work chamber and to the suction chamber for passage therethrough of a partial fuel quantity during a part of the compression stroke of the piston, said relief conduit being controlled by at least one control edge of the piston and a control element actuated by said fuel injection quantity control device both arranged in line to one another for delivery of the partial fuel quantity to the suction chamber, when the piston has executed a predetermined pre-stroke of its compression stroke, during which time the remaining fuel has reached the injection pressure, and a control slide further controlling the cross section of said relief conduit in line to said control edge and said control element to selectively block or throttle the fuel flow through said relief conduit.

2. A fuel injection pump as defined by claim 1, wherein at least one control groove is provided in the pump piston to control the relief conduit.

3. A fuel injection pump as defined by claim 1, wherein a cylinder wall is associated with said pump piston and at least one control groove provided in said cylinder wall serves as said control means for control of the relief conduit.

4. A fuel injection pump as defined by claim 3, further including at least one control groove in said piston associated with said at least one control groove in said cylinder wall.

5. A fuel injection pump as defined by claim 1, wherein said housing means includes a sleeve having a cylinder wall defining the bore, and said relief conduit includes a throttle bore disposed in said cylinder wall.

6. A fuel injection pump as defined by claim 1, wherein said throttle bore is disposed transversely to said pump piston in said cylinder wall.

7. A fuel injection pump as defined by claim 1, wherein said control slide is actuatable arbitrarily.

8. A fuel injection pump as defined by claim 1, wherein an rpm governor associated with said pump actuates displacement of said control slide.

9. A fuel injection pump as defined by claim 8, wherein said rpm governor and an arbitrary means selectively actuate said control slide.

10. A fuel injection pump as defined by claim 1, wherein said control slide is disposed perpendicularly to the pump piston and a Bowden cable cooperates with a spring to displace said control slide.

11. A fuel injection pump as defined by claim 8, wherein a centrifugal governor comprises said rpm governor and a governor lever of the centrifugal governor effects actuation of said control slide.

12. A fuel injection pump as defined by claim 11, wherein said housing means includes a fluid-filled chamber, an extremity of said control slide remote from the rpm governor is disposed in said fluid-filled chamber, and said fluid-filled chamber is provided with a connecting conduit including a throttle, whereby displacement caused by the governor is damped.

13. A fuel injection pump as defined by claim 11, wherein said relief conduit includes first and second channels, the first channel disposed between said pump chamber and said control slide, the second channel disposed between said control slide and an orifice in said pump piston, said control slide controlling said relief conduit upstream of said orifice disposed downstream therefrom.

14. A fuel injection pump as defined in claim 13, wherein the control slide is actuatable hydraulically.

15. A fuel injection pump as defined by claim 13, wherein a regulating slide is disposed on said pump piston downstream of said orifice for control of said relief conduit when starting the internal combustion engine.

16. A fuel injection pump as defined by claim 13, wherein at least one control groove is provided in said housing means having an annular cross-section, said control groove opening to receive said partial quantity when displacement of said pump piston causes said control groove to communicate with said orifice, said partial quantity being proportional to communication established therebetween.

* * * * *